US006539560B1

(12) United States Patent
Grieco et al.

(10) Patent No.: US 6,539,560 B1
(45) Date of Patent: Apr. 1, 2003

(54) HEAD SUPPORT DEVICE

(76) Inventors: Amanda Jill Grieco, One Meadow La., Huntington, NY (US) 11743; Carolyn Jean Kopprasch, 6 Quail Hill Rd., Huntington, NY (US) 11743; Amelia Christoforou, 1598 Laurel Hollow Rd., Syosset, NY (US) 11791; Jamie Elise Kates, 27 E. Gate Rd., Lloyd Harbor, NY (US) 11743

( * ) Notice: Subject to any disclaimer, the term of this patent is extended or adjusted under 35 U.S.C. 154(b) by 0 days.

(21) Appl. No.: 09/695,614

(22) Filed: Oct. 24, 2000

(51) Int. Cl.[7] ..... A45D 44/10

(52) U.S. Cl. ..... 4/523; 4/621; 297/406; 297/408; 297/410

(58) Field of Search ..... 4/523, 519, 575.1, 4/621; 297/391–410

(56) References Cited

U.S. PATENT DOCUMENTS

| | | | | | |
|---|---|---|---|---|---|
| 522,192 | A | * | 7/1894 | Browne | 297/407 |
| 2,789,625 | A | * | 4/1957 | Christie | 297/410 |
| 3,999,561 | A | | 12/1976 | Gusman | 132/9 |
| 4,352,216 | A | | 10/1982 | Grim | 4/523 |
| 4,385,408 | A | | 5/1983 | Rhodes | 4/523 |
| 4,389,740 | A | | 6/1983 | Henry | 5/575 |
| 4,401,111 | A | | 8/1983 | Blackstone | 128/75 |
| 4,411,032 | A | | 10/1983 | Lewy | 4/523 |
| 4,508,109 | A | * | 4/1985 | Saunders | 602/33 |
| 4,671,267 | A | | 6/1987 | Stout | 128/156 |
| 4,763,364 | A | | 8/1988 | Morgan | 4/523 |
| 4,828,257 | A | | 5/1989 | Dyer et al. | 272/129 |
| 4,887,326 | A | | 12/1989 | O'Brien et al. | 5/421 |
| 4,949,407 | A | | 8/1990 | Singer et al. | 4/523 |
| 5,332,287 | A | * | 7/1994 | Whitmyer | 297/405 |
| 5,377,365 | A | | 1/1995 | Hakim | 4/523 |
| 5,393,297 | A | | 2/1995 | Kristoff | 601/57 |
| 5,722,420 | A | | 3/1998 | Lee | 128/733 |
| 5,799,617 | A | | 9/1998 | Long et al. | 119/712 |
| 5,835,609 | A | | 11/1998 | LeGette et al. | 381/187 |
| 5,926,879 | A | | 7/1999 | Davis | 5/636 |
| 5,978,980 | A | | 11/1999 | Flora | 4/523 |
| 5,984,883 | A | | 11/1999 | Elnar | 601/86 |
| 6,050,965 | A | | 4/2000 | Pillai | 602/18 |
| 6,062,172 | A | | 5/2000 | Long et al. | 119/712 |
| 6,082,462 | A | | 7/2000 | Lyden | 169/24 |

* cited by examiner

*Primary Examiner*—Gregory Huson
*Assistant Examiner*—Kathleen J. Prunner
(74) *Attorney, Agent, or Firm*—Morgan & Finnegan, LLP

(57) ABSTRACT

A head support device comprised of adjustable occipital pads which provide cranial support through placement on the mastoid process of the skull. The support device is vertically and laterally adjustable so that the complete weight of the skull is supported by the pads placed over the mastoid process.

1 Claim, 5 Drawing Sheets

Figure. 1C
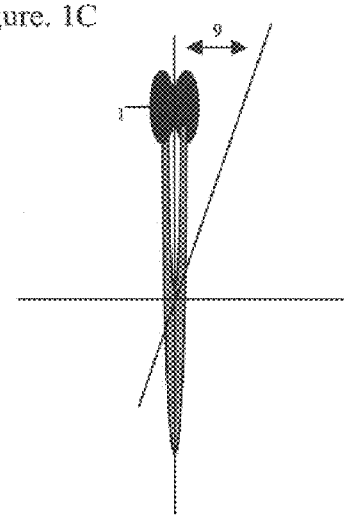
Figure.1A
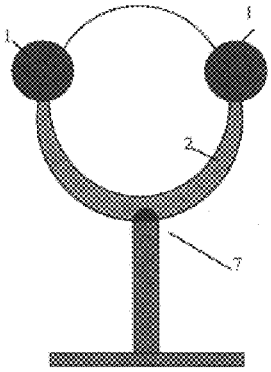
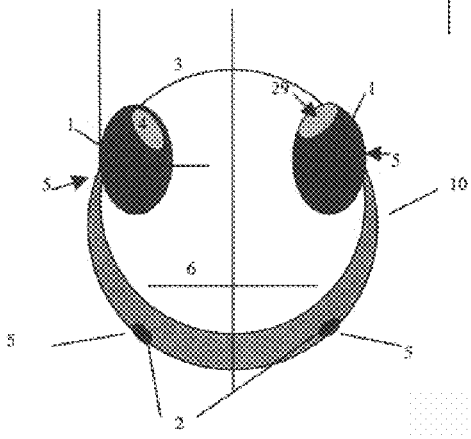
Figure. 1B

26

1
27
5
25
27

28

HEAD SUPPORT DEVICE

FIELD OF INVENTION

The present invention relates generally to a device which supports the mastoid process of the skull instead of the cervical spine. When placed in a supine position with the pressure on the neck, and the head unsupported, progressive muscle fatigue can lead to hyper-extension of the cervical spine. By removing the pressure from the neck, painful neck conditions that occur when the neck is placed at backward angles, can be prevented.

BACKGROUND OF THE INVENTION

Cervical radiculopathy, is a disorder that is commonly referred to as a "pinched nerve," and roughly 85 in every 100,000 people will suffer from it. Although it is more common in older people, cervical radiculopathy can effect people at any age. It is usually caused by three main conditions: a herniated disc or discs in the neck and upper spine, cervical arthritis, or whiplash and trauma which stretches the nerve. It may be defined as pain in the distribution of a specific cervical nerve root as a result of compressive pathology whether from herniation, spur formation or hypermobility states. When the head is arched backward, pressure is caused by the narrowing of the intervertebral foramina through which the cervical nerve roots exit the cervical spine. This narrowing of the space around the nerve root causes pain. The symptoms include pain in the neck that moves towards the shoulder, arm or hand, weakness of the arm muscles and paresthesias. These symptoms are caused by the compression of the nerve root. When this compression/injury occurs, the synovial facet joints, which allow complex movements of flexion and axial rotation in addition to anteroposterior flexion and extension in the neck, refer pain into the neck, shoulders, and posterior head.

Cervical radiculopathy is most commonly diagnosed by checking the cervical spine for nerve root compression using the Spurling maneuver. This method consists of extending the head backwards and to the symptomatic side, where pressure is then applied to the top of the head. This movement and pressure compresses or further narrows the space in the foramina for the nerve root thus eliciting symptoms.

One example of a potentially harmful position which may cause cervical radiculopathy occurs when a person visits a hair salon and their hair is being shampooed in a salon sink before a haircut (or other procedure i.e. color, perm, etc.). In this situation, the head is extended over the sink and is maintained in position by muscle tone in the neck and shoulders. As muscles relax or become fatigued, hyper-extension can occur. Hyper-extension is combined with rotation and lateral flexion as the head is manipulated during the shampooing, rinsing, etc. When the stylist then also applies a mild compressive force while shampooing, further hyperextension of the cervical spine can be produced and the cervical nerve root can be compressed. In effect, a salon hair shampoo can be a prolonged Spurling maneuver. Whereas the Spurling maneuver is designed to elicit symptoms in a diagnoses, a salon shampoo can cause the cervical compression which initiates cervical radiculopathy. Inflammation can develop from nerve root compression resulting in a prolonged course of discomfort and potential disability.

SUMMARY OF THE INVENTION

The present invention addresses a need to prevent cervical nerve root compression, by providing support for the head at the mastoid process behind the ears, thereby relieving any weight the neck muscles would have supported when the head is suspended and manipulated in a manner similar to the Spurling maneuver, or a salon shampoo. As muscle relaxation and fatigue develop, hyperextension of the cervical spine can occur.

The invention provides a device and a method of using the device to support the neck and cranium in a backward extended position. The device prevents painful neck conditions/injuries which can occur when the neck is placed at a backward angle, creating pressure on, and potentially injuring cervical nerve roots. The device and associated method offer a quick and inexpensive support for the weight of the cranium through direct support, instead of the traditional method of supporting the cervical spine and relying on the client's muscle tone to maintain head position.

To avoid the posture of backward angle neck positions, the invention places support for the head, in its extended position on the mastoid process located behind each ear. By supporting the head directly, the device prevents cervical nerve root compression while maintaining the head in an extended position, thereby allowing it to be manipulated without the danger of injury. This method of support is adaptable to devices that prevent neck injuries like those which may occur in a hair salon. For example, any activity that requires hyperextension of the neck backward can use this device. The device can be used for any activity that normally would cause the neck and cervical column to support the weight of the head.

BRIEF DESCRIPTION OF THE DRAWINGS

FIGS. 1A–C, are different facial view's of one preferred embodiment of the device.

DETAILED DESCRIPTION OF THE PREFERRED EMBODIMENTS

Figure 2A:
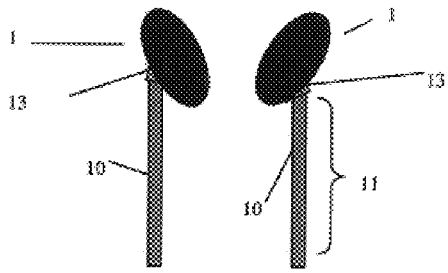
FIGS. 2A–C, are different embodiments of support arms for the device.

Hereinafter, the invention will be described in greater detail with reference to the preferred embodiments. However, it is understood that the device and associated method of the invention are applicable to provide head support from any number of surfaces, preferably from the lip or rim of the associated surface. The weight of a person's head should rest on the mastoid process of the skull behind the ears. This area provides the main support for the head, so as to minimize associated pressure anywhere else on the head or neck, and not rely on muscle tone to maintain proper head and neck alignment.

As shown, the head support device generally comprises a crescent frame, being of a size and shape to freely receive the back of the head of a person upon its top. The device is designed so that the entire weight of the person's head rests on the mastoid process of the skull. A crescent shaped frame is provided for supporting a head, and the head is not enclosed within the curve. The frame may be a single piece or may have multiple components, such as a flat bottom portion and two curved or straight arms extending from the flat bottom portion, or two curved arms extending from a single securing means. The frame may be made from any suitable material of choice, such as nylon, plastics, rubber, wood, metal, or any combination of these types of materials which is strong enough to support the weight of its recipient, i.e. a child or adult. The material is preferably water resistant, non-porous, and non-degradable when placed in contact with aqueous materials, such as, for example commercial antiseptic or antibacterial cleaning agents.

Each end of the crescent frame is a support structure. The support structures are directly or indirectly connected to each other through the crescent shaped frame, or alternatively, the support arms form the frame. Connected to the ends of the support structures are pads, at least one of which is connected to each support structure, wherein the pads provide direct contact support for the head via the mastoid process of the skull.

Referring now to one embodiment of the invention, shown in FIGS. 1A–C, a device for supporting the weight of the head comprises two main parts; a crescent shaped frame, and a plurality of pads, 1, where the pads of the device support the head by contacting the mastoid process of the skull, located behind the ear. In this embodiment of the invention, the frame 2 is substantially a U-shaped curve and may be made of a single piece of material. Such material can be, for example, polyvinyl carbonate(PVC), or any other flexible to semi-flexible plastic to which a controlled pressure may be applied to each end of the U-shape frame 2, without cracking or extensively bending the material. Alternatively, the U-shaped frame, 2, may be made from an inflexible material, such as, for example, metal, wood derived materials or inflexible plastic. In either case, the material is preferably water resistant, non-porous, and non-degradable when placed in contact with aqueous materials, such as commercial antiseptic or antibacterial cleaning agents.

The pads are preferably connected to the U-shape frame, 2, at the end regions. The pads, 1, may be connected, at the terminus (FIG. 1A) or to the side of the ends (FIG. 1B), or any other position at the terminals as long as a portion of the pads 1 are located above and between the ends, 3, of the U-shape frame, 2. It is preferred that each pad provides a comfortably large area of contact for the head so as to distribute the pressure at the points of contact. This area of contact 4 preferably provides at least 1.0 $cm^2$ of direct contact, per pad, 1. The area of contact will vary depending upon the size of the head being supported and the number and shape of pads, 1, used on each side of the U-shaped frame, 2. The shape of the pads can vary from spherical to oval, rectangular or other shape.

At the bottom end, i.e. middle of the U-shape frame, 2, a securing means, is provided. The securing means may comprise one or more points of attachment, 5 for the device. In a preferred embodiment the securing means are attached equidistant, 6, from the center of the U-shape to provide balanced support when the device is attached to a vertical plane, or over the lip of an object. Alternatively, the device may be attached to a surface via a single point of contact, 7. The U-shaped frame of the device may be fastened to vertical or horizontal planes using a number of different means, such as, for example, suction, vacuum, molded housing, Velcro, or the support may be an integral part of the attached structure. As shown in FIG. 1C, the securing means can be ridged or preferably made to allow a small amount of flexibility or leeway, 9, when weight or pressure is applied. Referring back to FIG. 1B, the distance, 29, between the center of the support structure and the surface area of the pads in contact with the head is preferably between about 1.0 and 3.0 inches, preferably 2.5 inches when bearing weight. This distance provides clearance for the head so that no part of the back of the head contacts the frame structure. One skilled in the art will readily recognize that this distance will vary depending upon the specific use of the device. The pads, 1, may also be connected to the U-shaped frame, 2, at the ends of the frame with a pivoting means, 13, shown in FIGS. 2A–C, so that the distance between the pads can be increased or decreased depending on head size. The pivoting means, 13, may be, for example, a hinge-type device which allows the pads to be pivotally adjusted to accommodate different sized or shaped heads and other pivots.

Figure 2B:
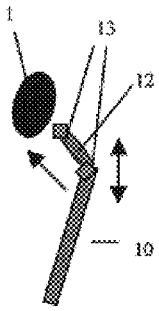
Figure 2C:
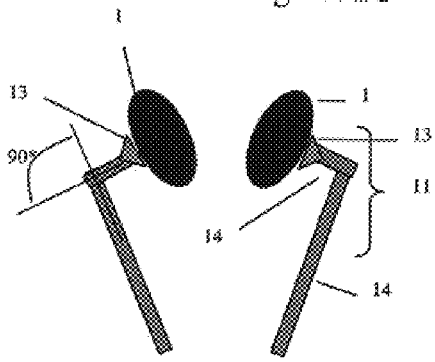

In FIGS. 2A–C, other aspects of the invention are described wherein the support arms themselves form part of the crescent shaped frame. Several embodiments of this aspect of the invention are shown in FIGS. 2A–C. In FIG. 2A, straight arms, 10, support the pads. In FIGS. 2B–2C, the support arm structures may be in curved portions, 11 where the pads, 1, are connected to the support arms by an extension means 12 which allows the user to adjustably control the distance between the support arms and the pad. The extension means can be lengthened and shortened as needed. The extension means may be connected to the pad and/or the support arm by a means that will allow the extension means or pad to pivot, 13, so that the pad can be adjusted against the head. In FIG. 2C, the curved support arm contains a fixed angle, 14, of no less than 90 degrees, wherein a pivotal means, 13, may optionally be used to link the pad and support arm.

Figure 3:
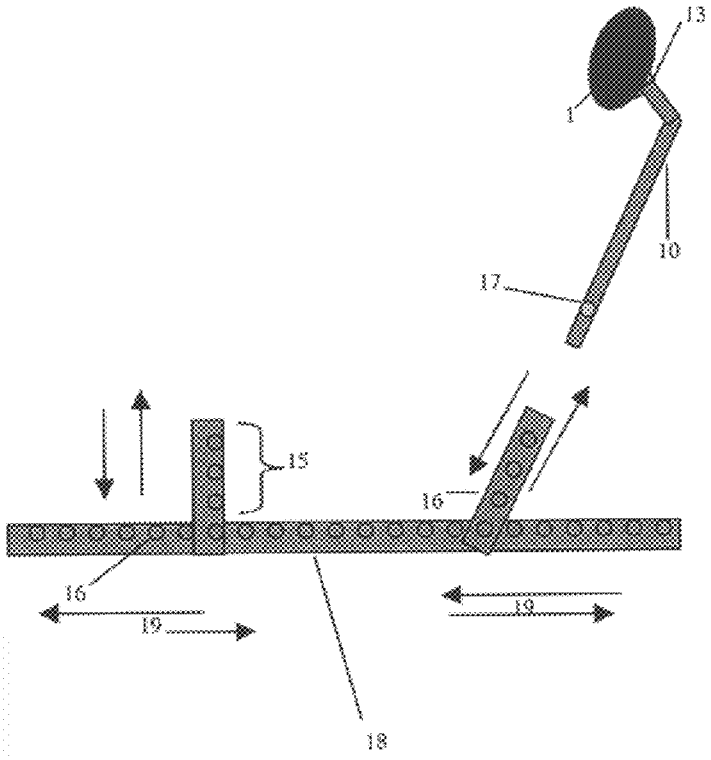
FIG. 3, is an embodiment of a base support for the device.

FIG. 3, provides one embodiment of an adjustable securing means useful for the support arms illustrated in FIGS. 2A–C. An adjustable securing means comprises sleeves, 15, for receiving, the support arms, 10, a plurality of holes, 16, for receiving locking means or locking pin, 17. In this embodiment, the adjustable securing means comprises a straight horizontal base, 18, and a plurality of support sleeves, 15, attached thereto. The support arms are slidably received into the support sleeve and may be adjustably locked into a variety of positions by a locking pin, 17. Optionally, a spring means is attached with the support sleeve for flexibly supporting the support arms. The support sleeves may be pivotally adjustable, and may include spring or other flexible devices which would allow the entire support device to be adjusted laterally and longitudinally relative to the base. The vertical height of the pads may be adjusted by sliding the support arms up and down within the support sleeve, 15. The support sleeves may be adjusted to accommodate different sized and shaped heads by moving the sleeves (pads) closer or farther apart as shown at 19, from each other along the base, 18, of the securing means.

Figure 4B:
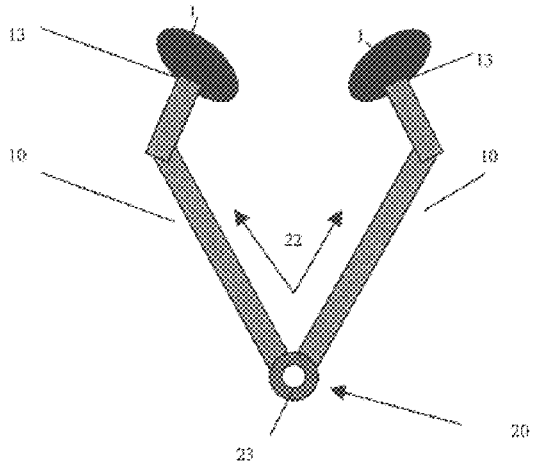
FIGS. 4A–B, are detailed views of the adjustably connected pads.
Figure 4A:
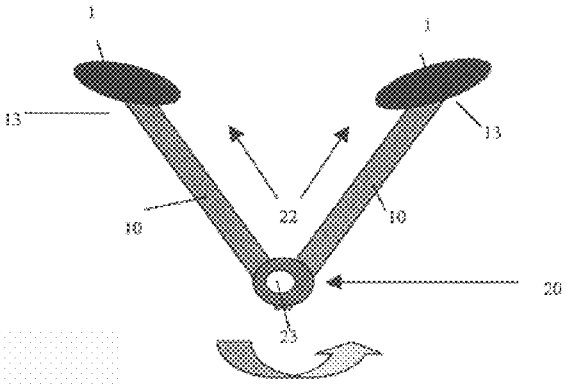

In yet another alternative embodiment, shown in FIGS. 4A and 4B, the support structures, 10, may be joined at the bottom by a single connection means, 20, such as a hinge, ball joint or screw connector such that the support arms form a V or substantially V-shape. 22. This embodiment allows the distance between the top of the support arms to be increased or decreased through a single point of adjustment, 23, of the base members. This connection means between the support arms and the pads may encompass the methods previously mentioned.

Figures 5A, 5B:
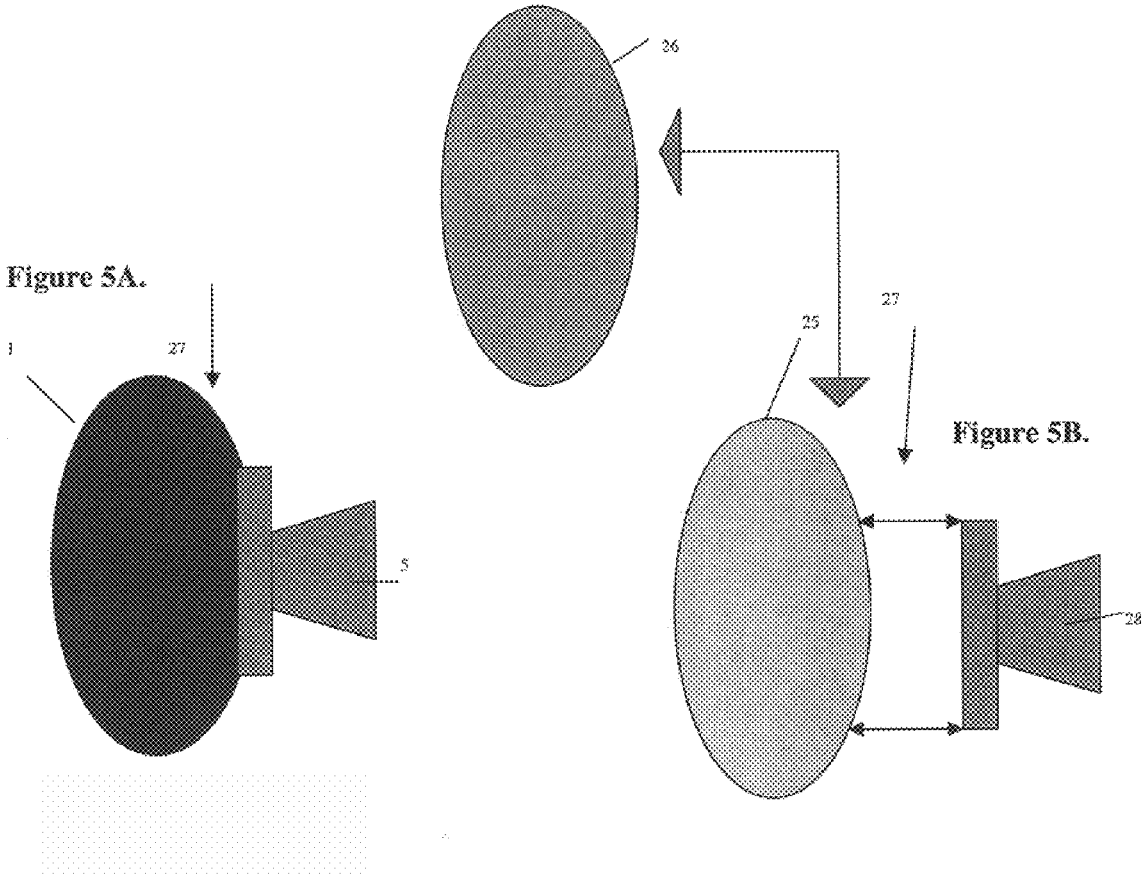
FIGS. 5A–B, are embodiments of the pads.

The pads, 1, as shown in FIGS. 5A–B, may be manufactured of many types of various materials, including natural or synthetic materials, such as, for example, metal, wood-derived materials, cotton, animal or plastic fibers, foam, sand, plastics or other like materials. The pads may exist as a single unit like FIG. 5A, or the pad may be a multi-layered pad like FIG. 5B, which, for example, is covered by a cushioning material, 25. The pad may comprise any shape, so long as the shape conforms to fit the mastoid process of the skull. All or a portion of the pads may optionally be covered with a cushioning material, 25, or protective cover, 26. The protective cover may be optionally used to sanitarily protect the pad area. The cover may be made of any suitable material of choice, such as, for example, plastic, nylon, or cloth. The cover, 26, may be of a conforming shape and size, and may optionally also contain cushioning, 25 therein. The protective cover may also be removably attached to a cushioning material and/or the pads by any suitable attachment and closure means, 27. The cushion, 25, may be formed into any suitable shape or size to functionally support the head. The cushion, 25, may be made from any suitable material of choice, such as, for example, foam rubber, gel, down, cotton, sand, Styrofoam, or synthetic fibers.

The pads may be connected, 28, to the U-frame, 2, by bolts, hinges, screws, ball joints, glue or by integrally attaching the pads to the end portions of the U-frame 2.

It will be apparent to those skilled in the art that various modifications and variations can be made in the device of the present invention without departing from the spirit and scope of the invention. Thus, it is intended that the present invention embraces all such modifications and variations within the spirit and scope of the appended claims.

What is claimed is:

1. A head supporting device comprising:

a first support arm, a second support arm each having a proximal and distal end, and an adjustable securing means, the proximal end of each of said support arms being attachable to said adjustable securing means, and the distal end of each of said first and second support arms being attached to at least one pad, wherein said pads are positioned such that the pads contact the head in the mastoid process of the skull wherein the adjustable securing means comprises a plurality of sleeves for receiving said support arms and a horizontal base to which the sleeves are pivotably attached.

* * * * *